US006675914B2

(12) United States Patent
Masak

(10) Patent No.: US 6,675,914 B2
(45) Date of Patent: Jan. 13, 2004

(54) PRESSURE READING TOOL

(75) Inventor: Peter Masak, West Chester, PA (US)

(73) Assignee: Halliburton Energy Services, Inc., Houston, TX (US)

( * ) Notice: Subject to any disclaimer, the term of this patent is extended or adjusted under 35 U.S.C. 154(b) by 38 days.

(21) Appl. No.: 10/078,121

(22) Filed: Feb. 19, 2002

(65) Prior Publication Data

US 2003/0155153 A1 Aug. 21, 2003

(51) Int. Cl.[7] ..... E21B 47/06

(52) U.S. Cl. ..... 175/48; 73/152.22; 73/152.27; 166/250.07; 175/50

(58) Field of Search ..... 175/48, 50; 166/250.07, 166/311, 312, 177.7, 177.2, 222; 73/152.16, 152.22, 152.27, 152.47

(56) References Cited

U.S. PATENT DOCUMENTS 4,852,069 A * 7/1989 Clerke et al. ..... 340/856.3
5,214,251 A * 5/1993 Orban et al. ..... 181/102
5,309,997 A 5/1994 Nahm et al. ..... 166/292
5,644,076 A * 7/1997 Proett et al. ..... 73/152.41
5,676,213 A * 10/1997 Auzerais et al. ..... 175/58
5,770,798 A * 6/1998 Georgi et al. ..... 73/152.05
5,969,241 A * 10/1999 Auzerais ..... 73/152.16
6,164,126 A * 12/2000 Ciglenec et al. ..... 73/152.01
6,230,799 B1 5/2001 Slaughter et al. ..... 166/249
6,474,349 B1 11/2002 Laker ..... 134/22.12
2002/0189339 A1 * 12/2002 Montalvo et al. ..... 73/152.51

* cited by examiner

*Primary Examiner*—Hoang Dang
(74) *Attorney, Agent, or Firm*—Conley Rose, P.C.

(57) ABSTRACT

The pressure reading tool includes a housing with an interior chamber and an orifice extending from the chamber to the exterior of the housing. A pulse member with a magnetostrictive ring and an excitation source are disposed within the chamber to produce a highly agitated fluid discharge through the orifice. The magnetostrictive ring, chamber volume, and orifice cooperate to induce Helmholtz resonance frequencies in the fluid in the chamber to thereby enhance the agitation of the fluid discharge. A sheathing encapsulates the pulse member to protect it from contact with the fluid. A dampening element is also interposed between the pulse member and housing to isolate vibration.

16 Claims, 3 Drawing Sheets

PRESSURE READING TOOL

CROSS-REFERENCE TO RELATED APPLICATIONS

Not applicable.

STATEMENT REGARDING FEDERALLY SPONSORED RESEARCH OR DEVELOPMENT

Not applicable.

FIELD OF THE INVENTION

The invention relates to a method and apparatus for the removal of undesirable materials on the wall of an earth formation so as to allow the measurement of formation characteristics such as pressure. More particularly, the invention relates to a device that creates a wave discharge by pulsing a volume of fluid so as to produce a resonant oscillation in the fluid. The wave discharge is directed in the form of a concentrated beam against at least partially non-permeable membranes formed on the earth wall of a borehole in order to remove these materials from the wall of the borehole. Still more particularly, the described device creates oscillations that produce the wave discharge by using a Helmholtz resonance frequency in pulsing a fluid volume. The wave discharge will disintegrate mudcake formed on the earth formation borehole wall to allow the unobstructed measurement of formation pressure within the formation.

BACKGROUND OF THE INVENTION

The efficient recovery of subterranean hydrocarbons such as oil and gas is assisted by obtaining reliable data about the physical conditions in a formation of interest. For example, a target formation typically includes hydrocarbon fluids that are under high pressure. Accurately measuring the formation pressure where such pressurized materials reside promotes safe and cost-effective operations in nearly all phases of hydrocarbon recovery. However, techniques for measuring formation pressure must overcome a number of technical challenges. One obstacle to pressure measurement is the mudcake that drilling mud tends to deposit on the wall of the wellbore.

A wellbore is typically filled with a drilling fluid such as water or a water-based or oil-based drilling fluid. The density of the drilling fluid is usually increased by adding certain types of solids that are suspended in solution. Drilling fluids containing solids are often referred to as drilling muds. The drilling fluids cool and lubricate the drill bit and carry the cuttings uphole to the surface. The solids in drilling fluids also increase the hydrostatic pressure of the wellbore fluids. By selecting drilling fluids weighted to a particular density, the column of drilling fluids creates a pressure downhole, which is greater than the pressure of the fluids in the formation. When the drilling fluid pressure is greater than the formation fluid pressure, the well is said to be in an over balanced condition. Conversely, if the formation pressure is greater than the fluid column, then the well is said to be in an under balanced condition. Control of formation fluids flowing into the well under high pressure minimizes the risk of a well blowout.

While an over balanced condition prevents well blowouts, it also has disadvantages, such as increased drilling costs due to slower penetration into the formation. Drilling fluid pressure in excess of formation pressure slows the penetration of the drill bit into the formation. In certain well environments it is preferred to maintain a neutral or slightly under balanced condition so as to achieve drilling speeds faster than those achieved while drilling in an over balanced condition. Drilling Practices Manual, Preston Moore, P. 18–22 Pennwell Publishing, 1974. Consequently, it is desirable to maintain a neutral balance or a slightly under balanced condition to maximize drilling penetration into the formation.

Drilling fluids create a mudcake as they flow into a formation by depositing solids on the inner wall of the wellbore. The mudcake on the wall of the wellbore tends to act like a filter and tends to isolate the high-pressure fluids of the wellbore from the relatively lower pressures of the formation. The mudcake helps prevent excessive loss of drilling fluid into the formation. The static pressure in the wellbore and the surrounding formation is typically referred to as hydrostatic pressure. Pressure in the formation beyond the mudcake gradually tapers off with increasing radial distance outward from the wellbore.

The measurement of formation pressures during drilling operations assists in locating strata most likely to produce hydrocarbons efficiently. Typically after the borehole is drilled, the well is logged by lowering a package of sensors downhole that gather data about the formation. Pressure data is useful in judging when a formation contains hydrocarbons and when such a formation may economically produce hydrocarbons. Often a wellbore may pass through more than one hydrocarbon-bearing formation, and formation pressure data assists the drilling engineer in determining whether to halt or continue drilling.

Further, the ability to monitor formation pressure during drilling is important to the desired practice of continuously adjusting the drilling mud density. This facilitates drilling through the maximum amount of formation in the shortest amount of time.

To maintain the proper condition during drilling, whether neutral, over balanced or under balanced, it is necessary to measure the pressure of the formation fluids at the vicinity of the drill bit. However, the dynamic environment near the drill bit makes measurement of the formation fluids particularly difficult during logging while drilling (LWD) operations. In addition, the mudcake that forms on the wall of the borehole presents a further difficulty in determining formation fluid pressure at the bit during drilling. This mudcake forms a relatively non-permeable barrier between the instrument on the one side and the formation fluids on the other. The mudcake barrier hinders accurate measurement of the pressure of the formation fluids.

Prior art sensors are generally not capable of measuring formation fluid pressure during drilling. Consequently, rig personnel must closely monitor the drilling fluids flowing from the borehole for signs of increased formation fluid pressure. This often entails temporarily halting the drilling operation to allow pressure measurement of the formation. Once the drilling fluids show evidence of formation fluids flowing up the borehole, drilling is stopped and corrective measures are taken. However, this approach has particular drawbacks; and, it would be desirable to determine formation fluid pressure at the bit during drilling.

One such prior art instrument is a reservoir description tool (RDT) such as that disclosed in U.S. Pat. No. 5,644,076 (the '076 patent) entitled "Wireline Formation Tester Supercharge Correction Method", incorporated herein by reference in its entirety. The RDT of the '076 patent includes a pressure sensing element mounted within a chamber of a housing having a piston to create a vacuum within the housing chamber. Hydraulic pads force the housing against the borehole wall; and, as the piston retracts to create a pressure reduction, a drawdown pressure removes the mudcake lining from the borehole wall. Fluids in the formation then enter the housing chamber allowing the pressure-sensing element to take a pressure reading. This tool allows only stationary measurements because drawdown pressure requires a tight seal between the housing and the borehole wall. This is undesirable because, aside from being time consuming, stationary measurements provide only discrete data points, not a continuous log. The drawback to discrete data points is that the fluid pressure between the discrete data points may vary dramatically and unpredictably.

Another borehole tool for removing the mudcake to measure the pressure of the formation fluids is disclosed in U.S. Pat. No. 5,969,241 (the '241 borehole tool) incorporated herein by reference. The '241 borehole tool measures pressure from within the borehole. A portion of the borehole wall is isolated from the surrounding borehole fluids by placing the chamber of the '241 borehole tool against the borehole wall. The chamber comprises a recess in an exterior surface of the '241 borehole tool. This patent describes an acoustic horn as the mechanism by which to excite fluids in a chamber. The mudcake present on the isolated portion of the borehole wall is disintegrated by an ultrasonic transducer, actuated by a piezoelectric stack, housed within the chamber. A pressure gauge then measures the pressure of the chamber to indicate the pressure of the earth formation.

Such a prior art tool also has deficiencies. For example, this borehole tool is inefficient because its vibrational energy does not transfer directly to the fluid. The vibrating born is limited in the efficiency by which it transfers electrical energy to acoustical wave energy. Excitation of the piezoelectric stack creates a longitudinal wave resonance within the ultrasonic transducer. As the ultrasonic transducer resonates longitudinally, the vibrational energy is transferred to the fluid. However, the mechanical coupling of the ultrasonic transducer to the fluid is poor, thus much of the vibrational energy imparted by the piezoelectric stack remains in the ultrasonic transducer. This inefficient energy transfer is expected to reduce the vibrational energy available to break down the mudcake. Further, such tools are not compact and are not easily installed in the drill string, which must pass through the confined area of the borehole.

Notwithstanding the foregoing described prior art, there remains a need for a device that possesses the features of efficiently transferring vibrational energy to create a focused wave discharge that may be used to remove mudcake from a borehole wall. Further, it is desired that such a device may be utilized so as to minimize any interruption to the drilling process. It is also desired that such a tool be capable of use on different down hole assemblies such as wire line operations and near the drill bit in drilling operations. Additionally, the tool should be able to take pressure measurements on a continuous or near-continuous basis as the drill string descends the well bore.

SUMMARY OF THE INVENTION

The present invention overcomes the aforementioned deficiencies of the prior art by providing a device that generates rhythmic pressure pulsations within a fluid-filled chamber, thereby producing a pressure wave discharge, which exits through an orifice of the chamber in a focused beam. The pulsations produced by the device include Helmholtz resonant frequencies for the geometry of the chamber; Helmholtz resonant frequencies efficiently transfer energy from pulse elements of the device to the fluids in the chamber. The device directs pressure waves in the fluids in the chamber through an orifice that focuses the waves against the borehole wall in the form of a concentrated beam. The wave discharge removes mudcake from the borehole wall, thereby opening a passage from the interior of the formation to the device chamber. In this manner pressure transducers associated with the device may accurately measure pressure from the formation. The device of the present invention operates with a speed that allows it to be used on a continuous to near-continuous basis. If disposed on a drill string, the drilling operation need not be slowed or halted in order for the present acoustic jet to function. Further the device may be used on both wireline operations and drilling operations.

The pressure reading tool of the present invention overcomes the deficiencies of the prior art by applying a fundamentally different approach to the removal of mudcake from borehole walls. For example, the '241 borehole tool induces vibrational frequencies in an acoustic horn to transfer the vibratory energy to the fluid. The tool of the present invention induces a resonance in the fluid itself. Thus, the poor energy transfer between the acoustic horn and fluid is eliminated. Further, the tool of the present invention concentrates and focuses the wave energy so as to minimize the loss of energy while simultaneously maximizing the energy brought to bear against the borehole wall.

One embodiment of the present invention includes pressure reading tool having a housing with an interior chamber and an orifice extending from the chamber to the exterior of the housing. A pulse member with a magnetostrictive ring and excitation source is disposed within the housing chamber to produce a highly agitated fluid discharge through the orifice. The magnetostrictive ring, chamber volume, and orifice may be designed to cooperate to induce Helmholtz resonance frequencies in the fluid in the chamber to thereby enhance the agitation of the fluid discharge. A sheathing may be used to encapsulate the pulse member to protect it from contact with the fluid. A dampening element may also be interposed between the pulse member and housing to isolate vibration.

In operation, the tool is disposed in the wall of the drill stem having a drill bit for penetrating the formation and forming a borehole. An impermeable membrane in the form of mudcake forms on the borehole wall due to the drilling fluids. A portion of the borehole wall is isolated by placing the tool against the borehole wall. The pulse member is actuated to modulate the chamber volume to produce agitated fluids within the chamber. The fluids are agitated at a high frequency within the chamber. The tool directs a stream of pressure waves through the orifice and against the impermeable membrane to remove the impermeable membrane. A pressure transducer communicates with the chamber to read the pressure of the formation fluids. These pressure readings are communicated with the surface to direct the drilling of the bit through the formation. The readings may be continuous while drilling.

Thus, the present invention comprises a combination of features and advantages that enable it to overcome various problems of prior art pressure measuring devices. The various characteristics described above, as well as other features, objects, and advantages, will be readily apparent to those skilled in the art upon reading the following detailed description of the preferred embodiments of the invention, and by referring to the accompanying drawings.

BRIEF DESCRIPTION OF THE DRAWINGS

For a detailed description of a preferred embodiment of the present invention, reference will now be made to the accompanying drawings, which form a part of the specification, and wherein.

DETAILED DESCRIPTION OF THE PREFERRED EMBODIMENT

Figure 1:
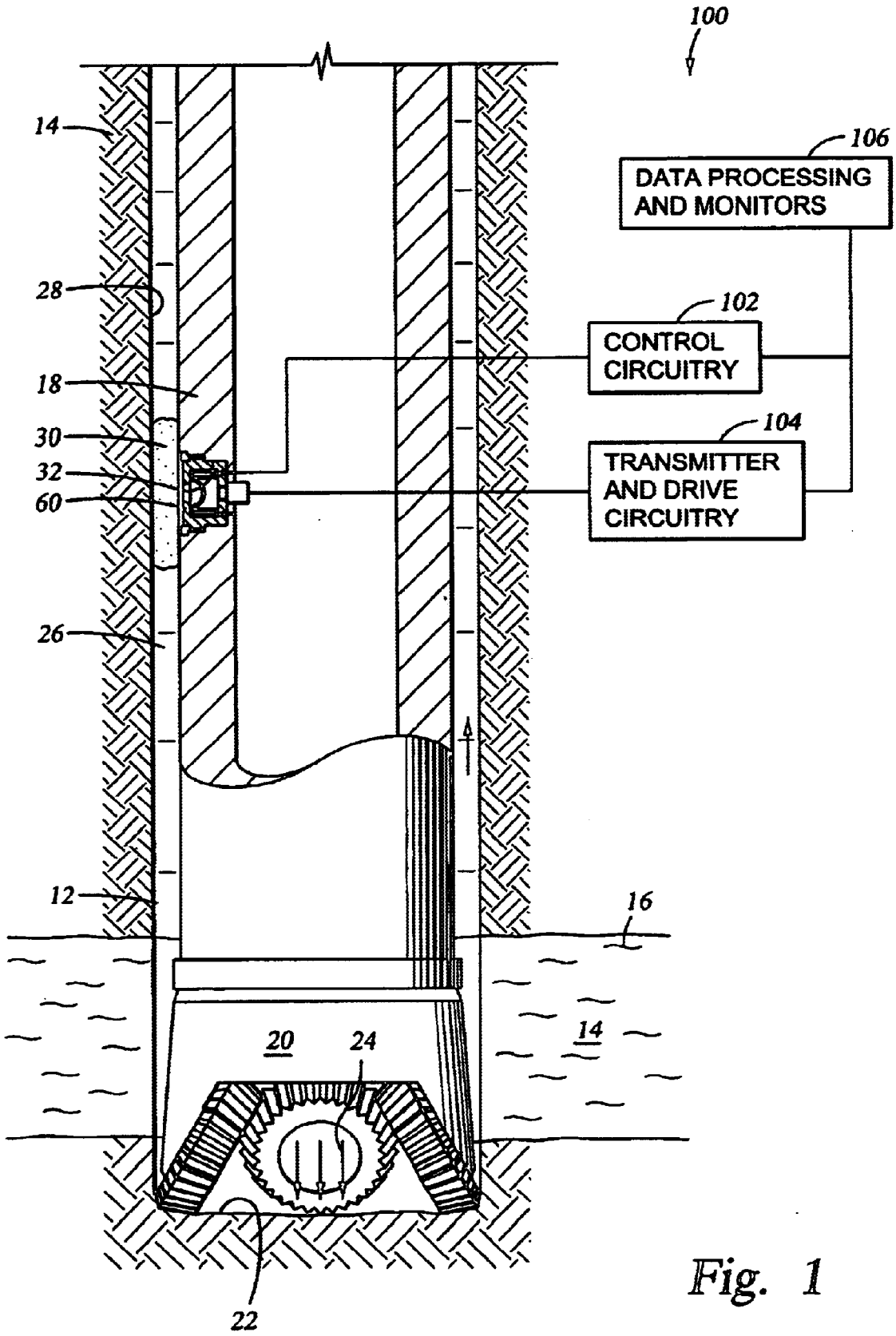
FIG. 1 is a cross-sectional close-up view of a drill string and well bore.

It should be appreciated that the invention may be embodied in many different forms. There are shown in the drawings, and herein will be described in detail, specific embodiments of the present invention. However, the present disclosure is an exemplification of the principles of the invention. It is not intended to limit the invention to the particular illustrated embodiments, which can be modified in the practice of the invention. For example the present invention may be used while logging on a wireline cable or in logging while drilling. The present invention is particularly advantageous in logging while drilling as further described below. The term "logging" is used herein in its broadest sense to include recording any type of data representing characteristics of the formation as a function of depth, including particularly the measurement of formation fluid pressure.

Referring initially to FIG. 1, there is shown the use of an embodiment of the present invention for logging while drilling. The pressure reading tool 60 is shown disposed in a bottom hole assembly 10 for drilling a borehole 12. The borehole 12 extends from the surface down through a plurality of different earth formations such as exemplary formation 14. Formation 14 may include various formation fluids 16 such as water, gas and hydrocarbons. These formation fluids 16 are under pressure. The logging while drilling embodiment of the bottom hole assembly 10 includes various members including a drill collar or drill stem 18 with a drill bit 20 connected thereto. It can be seen that the drill bit 20 is penetrating the formation 14 at the bottom 22 of the borehole 12.

Drilling fluids 24 are pumped down through the drill string on which the bottom hole assembly 10 is disposed, to the bottom 22 of the borehole 12 and then return up the annulus 26, formed by the drill string and wall 28 of borehole 12, to the surface. The drilling fluids 24 lubricate and cool the bit 20 and remove the cuttings to the surface. As the column of drilling fluids circulates through borehole 12, some of the drilling fluid solids 24 accumulate on wall 28 of borehole 12 forming a mudcake 30. Mudcake 30 forms a relatively impermeable membrane between the drilling fluids and earth formation 14. A pressure drop typically occurs across mudcake 30.

The present pressure reading tool 60 is schematically shown disposed in aperture 32 of one of the drilling string members, such as drill stem 18. Alternatively, the tool may be disposed on various pieces of downhole machinery. For example, in the embodiment shown in FIG. 4 pressure reading tools are placed in stabilizer blades 40. Alternatively, the pressure reading tools may be placed on the drill stem 18 or on the drill collar. Alternatively, pressure reading tools may be positioned on a dedicated piece of machinery that is itself attached to the drill string. Similarly, the tool may be employed on a wireline.

Figure 4:
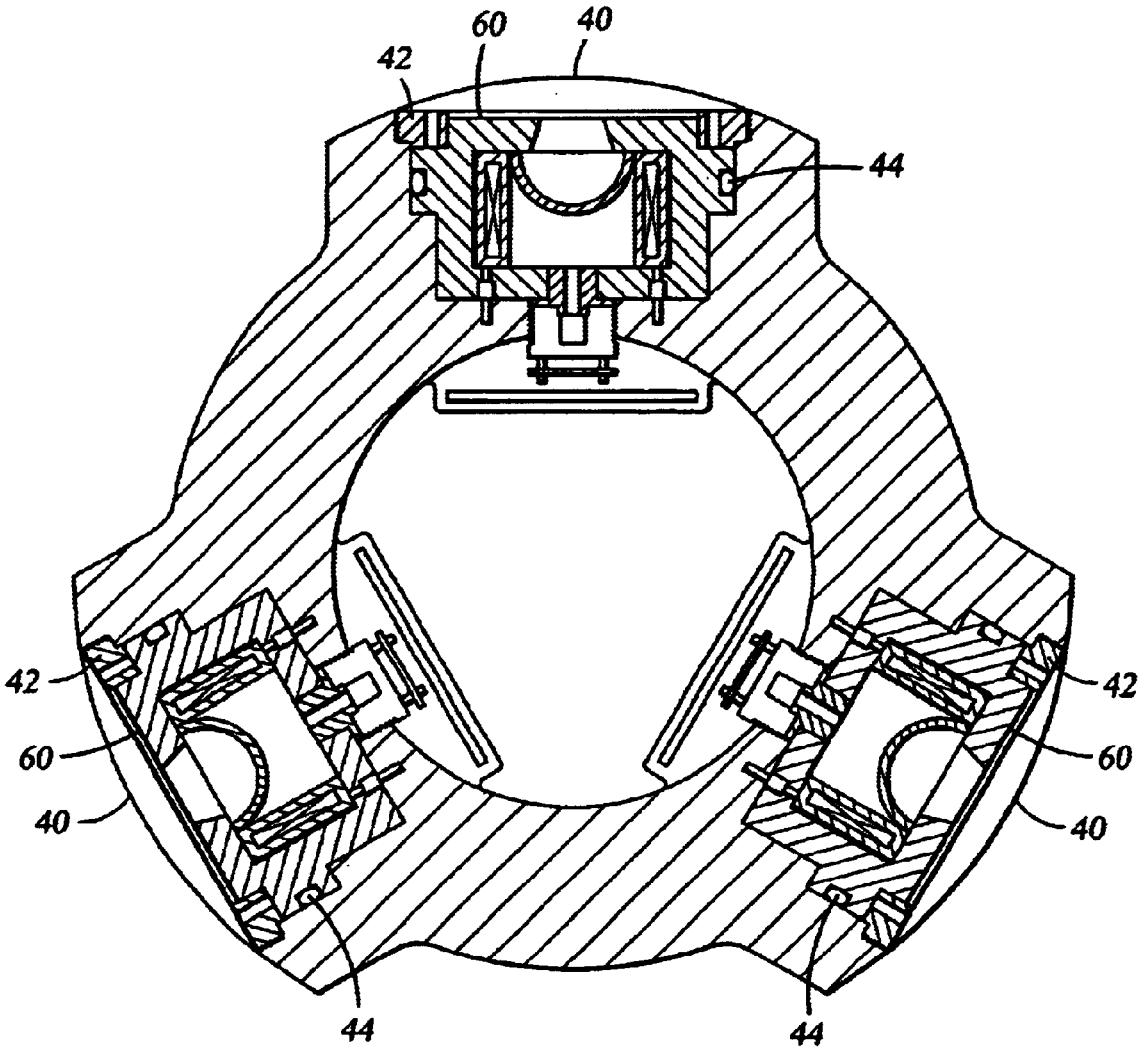
FIG. 4 is a cross-sectional view of three pressure reading tools positioned in three stabilizer blades of a down hole assembly.

While FIG. 1 portrays a single pressure reading tool disposed within the drilling apparatus, it should also be understood that more than one such tool may be included in any particular down hole assembly. For example, in one embodiment three pressure reading tools are disposed within the same drill collar or drill stem. As shown in FIG. 4, a particular drill collar has three stabilizer blades 40. There is a tool of the present invention disposed in each of the three stabilizer blades. In that embodiment, each of the three tools is at the same horizontal position on the drill stem; however, each tool is separated radially. In this manner, the three tools record formation pressure from sections of the formation at differing azimuthal positions. In an alternative embodiment a drill collar or drill stem may be arrayed with multiple tools at differing horizontal positions. There is an advantage associated with the use of multiple pressure reading tools. As the number of such tools increases, so does the chance of successfully obtaining an accurate formation pressure reading at a particular location. Conditions inherent in drilling, such as the vibrations and mechanical shocks found in the drilling environment, raise the possibility that mechanical equipment such as the pressure reading tool may be rendered inoperable. Likewise, a poor seal between the borehole wall 28 and orifice 76 of the tool may affect the pressure reading taken by the tool. In both these instances, the placement of multiple tools on the drill string increases the chance of a successful reading.

In both FIG. 1 and FIG. 4 tool 60 is directed radially outward toward mudcake 30. In this manner, tool 60 produces and directs a wave discharge for removing the mudcake to allow the measurement of formation fluid pressure while drilling as hereinafter described in detail.

Figure 2:
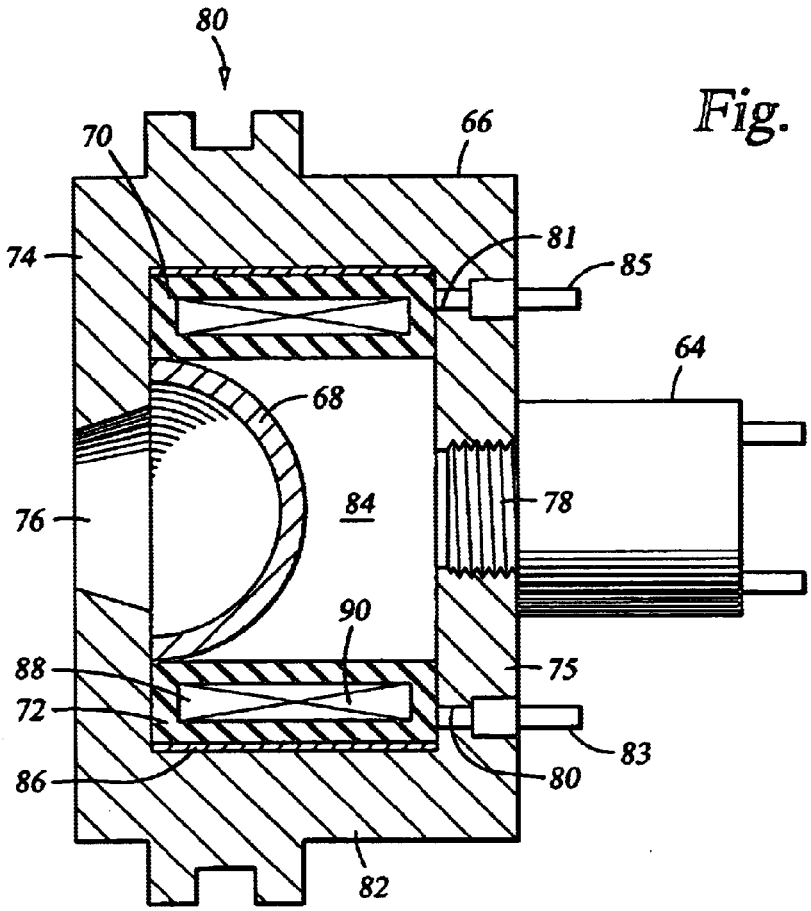
FIG. 2 is a cross-sectional view of a preferred embodiment of the present invention.

Referring now to FIG. 2, there is shown a preferred embodiment of the tool 60, which includes a pressure reader 64, a housing 66, and pulse device 70 for producing an agitated fluid discharge using Helmholtz resonance frequencies, thus enabling pressure readings of the earth formation. Housing 66 is generally defined by a cylindrical wall 82, an outer cap 74, and an inner cap 75. The generally hollow interior of housing 66 forms a chamber 84. Chamber 84 itself is generally cylindrical in shape, as it is defined by cylindrical wall 82, outer cap 74, and inner cap 75. Outer cap 74 includes an orifice 76. Outer cap 74 may be at least partially hardened against frictional wear caused by movement across borehole wall 28. Hardening of outer cap 74 may be through a surface treatment or a "wear plate" mounted on outer cap 28. Inner cap 75 is adjacent the inside diameter of drill stem 18 and includes a conduit 78 at its center, which is substantially opposite orifice 76 in outer cap 74. Inner cap 75 also includes one or more feed-through holes 80, 81 for receiving electrical conduits 83, 85. Outer cap 74 or inner cap 75 may be removable to allow access to chamber 84.

The tool has been described as having a chamber with a generally cylindrical interior geometry. While such a shape is believed to be advantageous for the transfer of energy from an electrical form to an acoustic form, the chamber may nevertheless assume other configurations. Any chamber geometry is possible, including, but not limited to, conical, spherical, cubic, rectangular, tetragonal, pyramid-shaped, elliptical, ovoid, parabolic, and polygonal.

Conduit 78 is also preferably substantially opposite orifice 76. While this is believed advantageous, alternative placements of conduit 78 are also possible. For example, conduit 78 could be placed in cylindrical wall 82. Also, conduit 78 could be placed in an off-center position on inner cap 75. These examples are for illustrative purposes only and are not meant to be limiting.

According to the embodiment as shown in FIG. 2, outer cap 74 is curved so as to follow the shape of borehole wall 28. Outer cap 74 would be disposed adjacent the borehole wall. In this embodiment, outer cap 74 may be hardened to withstand the contact with borehole wall 28. In alternative embodiment, however, outer cap 74 is positioned some distance from borehole wall 28 so as to avoid direct contact with borehole wall 28. As shown in FIG. 4, the pressure reading tool is positioned in a stabilizer blade of the downhole assembly. In this configuration, stabilizer blade 40 contacts borehole wall. Outer cap 74 is slightly recessed so that it does not directly contact borehole wall. In the configuration of FIG. 4, outer cap 74 need not assume a curved shape; nor does it need to be hardened.

Preferably, housing 66 is sufficiently compact to fit into a drill collar, drill stem 18, stabilizer blade 40, or wireline device. The pressure reading tool may be preassembled and installed as a unit in a machined or precut aperture 32 of a selected drill piece. Some known attachment means may be used in order to affix the pressure reading tool to the drill piece. Known attachment methods include, but are not limited to, a pressure fitting, pins, threading, bolting or gluing. Preferably, a threaded lock ring 42, shown in FIG. 4, secures the pressure reading tool to the drill piece. The body of housing 66 may also seal aperture 32 so as to prevent the interior of the drill string passing fluids to or from the exterior of the drill string. This is preferably accomplished by o-ring seals 44. Material selection for housing 66 is largely driven by downhole environment conditions. Generally, a corrosion resistant steel will provide the necessary ruggedness for borehole applications. Acceptable materials include steels such as 17–4PH or MP-35N.

Figure 3:
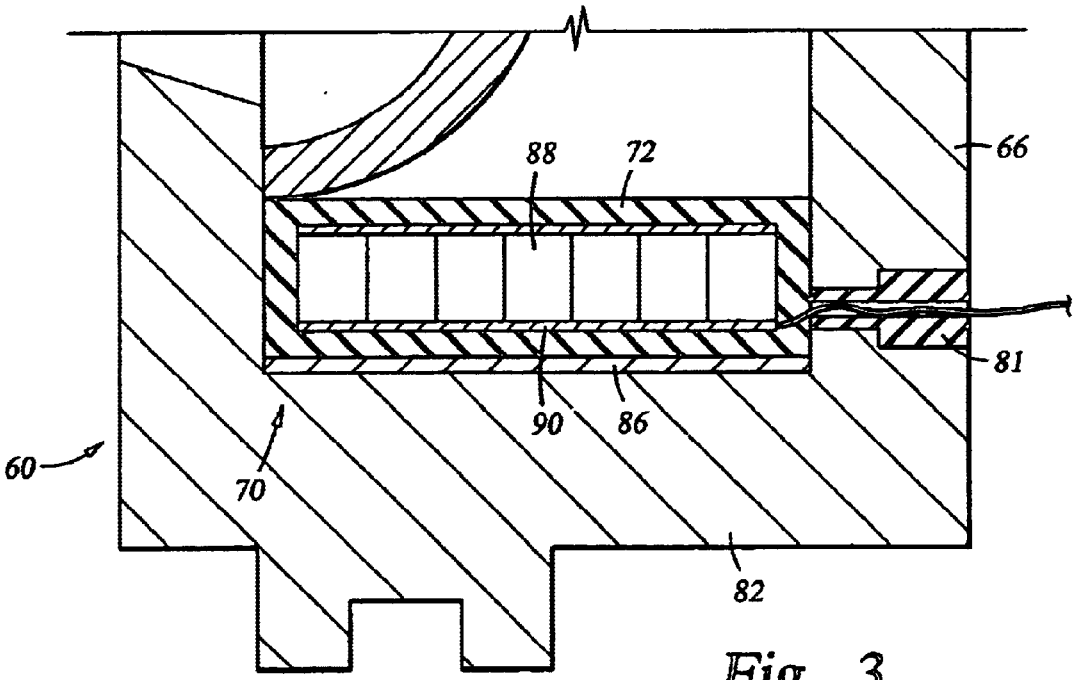
FIG. 3 is a cross-sectional close-up view of the preferred embodiment of FIG. 2.

Referring now to FIGS. 2 and 3, cylindrical wall 82 of chamber 84 is preferably at least partially lined with dampening element 86. Preferably, dampening element 86 is made of a relatively soft material such as lead. Because tool 60 may be used along with an array of wireline instruments, it is preferred that the operation of tool 60 be dampened to prevent the transmission of vibrations along the drill string. This serves to minimize interference with other drill string instruments. Thus, cylindrical wall 82 of chamber 84 is lined on its interior preferably with a layer of lead to absorb much of the vibrations. In lieu of a lining, dampening element 86 may be a lead ring formed to seat at least partially along interior cylindrical wall 82. It is emphasized that these are only two non-limiting examples of elements suitable for dampening. It is also emphasized that the dampening element is a convenient feature and may not be essential to the satisfactory operation of tool 60. Alternatively any members that constitute housing 66 such as cylindrical wall 82, outer cap 74, and inner cap 75 may be selected of a material and dimension sufficient to perform any needed dampening function.

Pulse device 70 is disposed within chamber 84 and comprises a member or members that can physically oscillate in response to a signal. In the preferred embodiment of FIG. 2, pulse device is a generally annular or ring-shaped member disposed within chamber 84. Pulse device 70 seats substantially contiguously along the interior surface of cylindrical wall 82, or, if present, along the interior surface of dampening element 86. Preferably, pulse device 70 extends along the length of cylindrical wall 82 such that the ends of pulse device 70 rest against the interior surfaces of outer cap 74 and inner cap 75.

In the preferred embodiment, pulse device 70 seats substantially contiguously along the interior surface of cylindrical wall 82. In this manner, the physical oscillations of pulse device 70 efficiently transfer energy to fluid in chamber 84 at all positions along the interior surface of pulse device 70. However, it is possible to configure pulse device 70 in an alternative manner. For example, rather than being configured as a single, ring-shaped body, pulse device 70 could comprise any number of discrete units, of any geometry. These separate units could be placed at different locations within chamber 84. A plurality of individual pulse device units could approximate the form and function of a ring-shaped pulse device when such individual units are placed in proximity to one another along the interior surface of cylindrical wall 82. Alternatively, discrete pulse device units could be placed on the interior surfaces of outer cap 74 and inner cap 75. Additionally, pulse device units could even be placed at some interior position of chamber 84. If housing 66 is selected such that it defines chamber 84 to have a non-cylindrical geometry, then pulse device 70 may also have an alternative configuration and placement in the chamber. It would also be possible, and would be within the scope of this invention, to construct housing 66 with recesses or voids so as to have a honeycombed configuration. In such a configuration, pulse device units could be disposed within the recesses of housing 66.

Pulse device 70 may itself be composed of separate elements. In the ring-shaped, preferred embodiment, shown in FIG. 3, pulse device 70 has pulse elements 88 at its core. Excitation source 90 wraps around pulse elements 88, and sheathing 72 excitation source 90. Sheathing 72 thus forms the external surfaces of the preferred pulse device 70.

Sheathing 72 is preferably made of an elastomeric material to insulate the pulse device 70 from harmful contact with borehole fluids and particulates. Accordingly, the material for sheathing 72 should be selected to provide a impermeable barrier between the borehole environment and pulse device 70. Another consideration in material selection is the need to efficiently couple the energy of pulse device 70 to the fluid in chamber 84. Thus, sheathing 72 should be a resilient medium that provides efficient transfer of pulsing motion from pulse device 70 to the fluid. Generally, the modulus of elasticity of the material for sheathing 72 should be closer to that of rubber than that of steel. Materials with relatively high material stiffness will tend to limit the motion of pulse device 70. Rubber meets the requirements of elasticity and impermeability. Other materials such as Teflon may also be designed to have the requisite material properties. Further, sheathing 72 also provides a resilient support for pulse device 70 in housing chamber 84. Preferably, the thickness of sheathing 72 should secure pulse device 70 within housing 66 without unduly impeding the oscillating motion of pulse device 70.

Still referring to FIG. 3, pulse device 70 includes a plurality of pulse elements 88 wrapped within excitation source 90. Pulse elements 88 physically distort in response to an excitation signal. As pulse elements 88 physically distort, the volume of chamber 84 rhythmically increases and decreases, thereby producing a pulsation of the fluid within chamber 84. Preferably, pulse elements 88 are a ring of magnetostrictive elements capable of radial oscillatory expansion and contraction when activated. Excitation source 90 can include windings that are capable of transferring magnetic flux signals. Magnetic flux is the excitation signal that causes magnetostrictive elements to physically distort. The windings of excitation source 90 are wrapped around the magnetostrictive elements and exit housing 66 via housing feed-through holes 80, 81. Outside the housing, the wires may connect with an external signal source. While feed-through holes 80, 81 allow the winding wires of excitation source 90 to exit, it is otherwise sealed to segregate fluid within chamber 84. Pressure boots may provide one mechanism by which to make the electrical connection from wiring to the pressure reading tool.

Alternatively, pulse elements 88 may be a plurality of piezoelectric elements. As with the magnetostrictive ring, the piezoelectric elements are formed into an annular or ring shape. A preferred piezoelectric material is PZT-5A Piezoelectric Material, available from EDO Corporation, Salt Lake City, Utah, 84115. Whether piezoelectric elements or magnetostrictive elements are used depends on the demands of a particular application. For example, it is generally understood that piezoelectric elements are more brittle than magnetostrictive elements and may be more easily damaged. However, a particular situation may require the higher frequency oscillations that are more efficiently provided by piezoelectric elements. In any event, magnetostrictive and piezoelectric elements are given as illustrative examples of a material that can produce harmonic pulsation of the fluids in chamber 84. Pulse elements 88 are not intended to be limited to these two materials.

Orifice 76 will focus the pressure wave discharge into a concentrated beam. However, one skilled in the art will understand that the profile of orifice 76 can be easily modified for alternate fluid discharges. Thus, nearly any profile may be utilized for chamber 84 and orifice 76. If a Helmholtz chamber is desired, the resulting volume and geometry must satisfy the Helmholtz resonance frequency requirements. In certain downhole applications, it is foreseeable that it may not be possible to design housing 66 to create Helmholtz resonance frequencies. In such cases, it will be apparent to one skilled in the art to adjust the geometry of housing 66 and orifice 76 to produce an agitated fluid discharge.

A Screen 68 is preferably positioned within chamber 84 on outer cap 74 proximate to orifice 76. Screen 68 can prevent borehole particulates from entering chamber 84. When the fluid in chamber 84 is vibrated, fluid in the immediate vicinity of orifice 76 develops the highest fluid velocity. It is preferable not to restrict such fluid movement. However, if screen 68 is placed too far from orifice 76, it may allow borehole particulates to enter chamber 84 and damage pulse device 70. Preferably, screen 68 is placed to allow the highest velocity fluid movement through orifice 76. Further, screen 68 includes a plurality of openings designed to minimize impedance to fluid movement. Preferably, screen 68 is formed of stainless steel and secured to outer cap 74. While particulates capable of damaging tool 60 are often present in a borehole environment, it is emphasized that satisfactory operation of tool 60 is not dependant on the presence of screen 68.

A pressure reader 64 is mounted to housing 66. Conduit 78 provides fluid communication between pressure reader 64 and chamber 84. Pressure reader 64 preferably includes a threaded portion that may engage mating threads within conduit 78. Alternatively, pressure reader 64 may be secured to housing 66 by some alternative means. Because conduit 78 provides access to chamber 84, the fluids in chamber 84 pass through conduit 78 and contact a surface of pressure reader 64 such that the pressure of the fluids can be measured. It is preferable to locate pressure reader 64 as closely as possible to chamber 84. A remotely mounted pressure reader 64 requires a longer conduit 78, which may be more susceptible to plugging by borehole particulates. Commercially available pressure transducers can be utilized as the pressure reader 64 in the present invention. One such pressure transducer is a strain gage based pressure transducer manufactured by Paine, Inc. Quartz gage pressure transducers are more accurate and may be used. Such devices are usually more bulky and thus of limited suitability to borehole applications.

While it is not essential to the invention, in the preferred tool 60, the geometry of housing 66, chamber 84, orifice 76, and pulse device 70 are selected to produce Helmholtz resonance frequencies in the fluid expected to be encountered in the drilling environment. Helmholtz resonance is a well-known scientific principle. The shape and design of Helmholtz cavities or Helmholtz resonators is also known in the industry. One kind of Helmholtz resonator is an enclosed cavity of fluid with an open port. If the volume of fluid in the cavity is compressed, the fluid attempts to spring back to its original volume. Physical oscillations in the fluid within a ported cavity tend to resonate at specific frequencies.

The natural resonant frequency for a spherical Helmholtz resonator ported with a cylindrical neck in an atmospheric environment may be represented by the following equation:

$$f_r = \frac{c}{2\pi}\sqrt{\frac{A}{LV}}$$

where c=speed of sound in the fluid

V=cavity volume

A=cross sectional area of the neck, and

L=length of the neck

This equation necessarily changes as the fluid is changed from air to another medium. Likewise, as other factors such as the geometry of the chamber and neck become more complicated, the classical equation breaks down. Hence the selection of an optimal frequency in the pressure reading tool must also be guided by trial-and-error methods. Given the changing environment in an active wellbore arising from factors such as changing pressures and the changing densities of fluids present in the wellbore, it is sometimes necessary to design a resonating chamber that can function across a variety of frequencies.

A preferred design of the present invention was tested in laboratory conditions. The fluid was a drilling mud with density of approximately 1500 kg/m$^3$. The speed of sound in this material was estimated at 1500 m/s. At approximately 42 kHz the preferred embodiment of the present invention displayed a relatively low impedance while retaining good sound pressure levels. At this frequency the design was found to generate a cylindrical standing wave in laboratory testing.

One preferred embodiment of pressure reading tool 60 previously described has the following dimensions. The diameter of the chamber 84 in the fully assembled tool, i.e., the chamber diameter as defined when pulse device 70 is in place, is approximately 1.10 in. The diameter of chamber 84 with pulse device 70 removed is approximately 1.75 in. No dampening element 86 was present. The annular pulse device 70 thus has a ring thickness of approximately of 0.325 in. The depth of chamber 84 is approximately 1.00 inch. Outer cap 74 has a thickness of approximately 0.250. Inner cap 75 has a thickness of approximately 0.50 in. The cylindrical interior wall is approximately 0.25 in. thick. Orifice 76, centered in outer cap 74, has an opening diameter, measured at the exterior wall of outer cap 74, of approximately 0.50 in.; and orifice 76 widens toward the interior of chamber 84 at an angle of approximately 28°.

In this preferred embodiment, pulse device 70, with an annular ring thickness of approximately 0.325 in., was further designed as follows. Sheathing 72 was as long as the interior length of chamber 84, approximately 1.00 in., and assumed the ring thickness of the pulse device 70, approximately 0.325 in. An annular-shaped magnetostrictive assembly, composed of a magnetostrictive ring with windings, was approximately 0.75 in. long and approximately 0.10 in. in thickness. The magnetostrictive assembly formed the interior of pulse device 70. The magnetostrictive assembly had an interior diameter of approximately 1.30 in. and an exterior diameter of approximately 1.50 in. Given the differences in diameters, the magnetostrictive assembly was thus placed in sheathing 72 in a slightly off center position. The distance from the interior surface of sheathing 72 to the interior surface of the magnetostrictive assembly was approximately 0.20 in. However, the distance from the exterior surface of sheathing 72 to the exterior surface of the magnetostrictive assembly was approximately 0.25 in. In the assembled pulse device the magnetostrictive assembly was placed equidistant from the interior surfaces of outer cap 74 and inner cap 75, approximately 0.125 in. from each.

In operation, rig personnel will install preferred tool 60 into a drilling structure such as a drill stem 18, on a stabilizer blade 40, or drill collar. The appropriate electrical connections are made to link pulse device 70 with a signal source. Pressure reader 64 may also be linked with an appropriate display device or recording device, usually located at a control point on the surface. Such a link is preferably done through an electronic data connection.

To take pressure readings during LWD, the assembled tool is lowered into borehole 12. When the drill string approaches a formation region of interest, several steps will take place. Of initial importance is the seal between orifice 76 of tool 60 and borehole wall 28. The measuring of formation pressure with the pressure reading tool is best accomplished when the tool is placed firmly against the formation wall. In one embodiment, the face, or outer cap 74, of tool 60 is curved so as to make full contact against the curved face of the borehole wall 28. Outer cap 74 seals against borehole wall 28 and traps fluids, such as drilling fluids within chamber 84. Alternatively, where outer cap 74 is recessed relative to stabilizer blade 40, it is stabilizer blade 40 or alternate drill string structure that forms a seal with borehole wall 28. A tight seal is provided between preferred tool 60 and borehole wall 28 to ensure that pressure reader 64 receives the pressure of formation 14, and not the fluids in borehole 12. Placement of multiple tools on a drill string, each tool placed at a differing radial position, increases the probability that the orifice of at least one such tool will be in sufficiently sealed contact with the borehole wall to assure an accurate pressure reading.

The procedure for obtaining a pressure reading continues with electrical signals of a chosen frequency or frequencies delivered to tool 60. These signals activate pulse device 70 at a corresponding mechanical frequency. Activation of pulse device 70 causes it to oscillate, thereby imparting a rhythmic expansion and contraction of the volume of chamber 84. The rhythmic expansion and contraction of the volume in chamber 84 imparts pressure waves in the fluid. This wave energy flows through the only point of discharge, orifice 76. Orifice 76 focuses the wave discharge into a concentrated beam. Because the pulsation frequency causes the fluid to resonate at a Helmholtz frequency, pulse device 70 efficiently transfers energy to the fluid discharge.

The near instantaneous result is a flow of wave energy expelled from the tool. Orifice 76 directs the wave discharge toward borehole wall 28 layered with mudcake 30. The fluid pulsations strike mudcake 30, flush away the mudeake 30, and thereby restore permeability to borehole wall 28.

At this point electrical signals to the tool can stop, and the fluid oscillation thereby ceases. The necessary period is allowed for the hydrocarbons in formation 14 to pressurize tool chamber 84. The time period needed to pressurize chamber 84 will vary depending on factors such as the permeability of the formation and the pressure in the formation. The fluids in formation 14 seep through borehole wall 28 and into chamber 84 through orifice 76. With hydraulic communication established via conduit 78, chamber 84 and orifice 76, pressure reader 64 can measure formation fluid pressure. As is known in the art, it is possible to estimate formation pressure without the need for the pressure to equalize between that of the formation and that of the chamber. Pressure reader 64 transmits the pressure data to the surface.

The tool allows for continuous or near-continuous readings of formation pressure. In the logging while drilling embodiment, the movement of the drill string downward as drilling progresses also moves the tool vertically downward. However, the tool receives pressure readings from a given point on the borehole wall prior to the time that the tool descends past this point of the borehole wall. The tool clears mudcake from the borehole wall and records the formation pressure associated with the cleared area of borehole wall, prior to the orifice moving past that cleared point. Once the orifice does descend past a point on the borehole wall that has been cleared and measured for pressure, the process can begin anew. At a new, lower point on the borehole wall, the tool clears mudcake and again records formation pressure. The points of pressure measurement can be closely spaced so as to allow recording of pressure data in a continuous or near-continuous fashion. In this manner the tool will take formation pressure readings at a series of points, in an ongoing fashion, while the drill string makes its normal descent in the formation. There is no need to halt drilling in order to make these pressure readings.

Preferred tool 60 provides a direct reading of formation fluid pressure that can be used to adjust the borehole pressure. That is, rig personnel can select a borehole pressure that prevents formation fluid from invading the borehole 12 without creating an excessive borehole pressure that slows drilling speed. Referring back to FIG. 1, during LWD, preferred tool 60 can be linked with a downhole telemetry system 100 to transmit formation pressure data uphole. For example, downhole telemetry system 100 could include control circuitry 102 to energize preferred tool 60 and a drive circuitry/transmitter 104 to receive pressure data from preferred tool 60 to transmit the pressure data to the surface. Drive circuitry/transmitter 104 may utilize a mud siren to transmit data in the form of pressure pulses in the drilling mud flowing uphole. Monitors 106 on the surface receive and process the pressure data transmitted by downhole telemetry system 100. Such a system could be configured to provide continuous transmission of pressure data. Alternatively, the drive circuitry could be designed to transmit pressure data only after a threshold pressure is sensed by pressure transducer. In any event, data transmission systems for LWD in the prior art are well known, and one of ordinary skill in the art will understand how to relay pressure readings obtained from preferred tool 60 to monitoring systems on the surface. Further, one of ordinary skill in the art will know how to modify drilling mud to create a specific borehole pressure.

A similar approach is followed for deploying preferred tool 60 during wireline logging operations. For wireline logging, a preferred tool 60 is usually one of several tools in a package lowered downhole. Thus, preferred tool 60 may transmit pressure data via the wireline cable to the surface. A continuous log requires that preferred tool 60 be dragged along borehole wall 28. While it is believed that tool 60 will remove mudcake nearly instantaneously, a similarly instantaneous pressure reading may not be possible. A lag time may be involved with wireline logging. Lag time calculations are discussed in the '076 patent referenced above and incorporated by reference in its entirety. Thus, pressure reader 64 provides pressure data that allows an accurate reading of formation fluid pressure even though the fluid pressure in chamber 84 and formation 14 have not equalized.

While preferred embodiments of this invention have been shown and described, modifications thereof can be made by one skilled in the art without departing from the scope or teaching of this invention. The embodiments described herein are exemplary only and are not limiting. Accordingly, the scope of protection is not limited to the embodiments described herein, but is only limited by the claims that follow, the scope of which shall include all equivalents of the subject matter of the claims. In the claims, the recitation of steps in a sequential order is not intended to require that the steps be performed in that order, unless explicitly so stated.

What is claimed is:

1. An apparatus for measuring formation pressure, comprising:

a housing having an interior chamber and an orifice extending from said chamber to an exterior of said housing such that fluids may pass into and out of said chamber in said orifice;

a member within said chamber to induce a modulation of fluids within said chamber; and a pressure reader in hydraulic communication with said chamber.

2. The apparatus of claim 1 wherein said modulation induces a Helmholtz resonance frequency in the fluid.

3. The apparatus of claim 1 wherein said member comprises at least one magnetostrictive element disposed within said chamber and an excitation element to activate said magnetostrictive element.

4. The apparatus of claim 3 further including a sheathing encapsulating said magnetostrictive element.

5. The apparatus of claim 3 further including a dampening member at least partially lining said chamber.

6. The apparatus of claim 5 further including a screen disposed around said orifice.

7. The apparatus of claim 1 wherein said member includes a pulse element disposed within said chamber, said pulse element being is capable of physical expansion and contraction.

8. The apparatus of claim 7 wherein said member further includes an excitation source associated with said pulse element, said pulse element and excitation source cooperating to modulate said chamber volume.

9. The apparatus of claim 1 wherein said member comprises a piezoelectric element.

10. An apparatus mounted on drill string for removing mudcake from the wall of a borehole having drilling fluid, comprising:

a housing having a chamber with a volume, and an orifice extending from said chamber to an exterior of said housing;

a magnetostrictive ring disposed within said chamber;

an excitation source associated with said magnetostrictive ring and cooperating with said magnetostrictive ring to modulate said chamber volume;

a sheathing encapsulating said magnetostrictive ring; and a pressure reader mounted on said housing and at least partially exposed to said chamber.

11. An apparatus connected to an external activating source for creating a pressure wave in fluid, comprising:

a housing defining a chamber having a volume capable of receiving a fluid, said housing having an outer wall with an orifice disposed therethrough, and an inner wall having at least one access hole therethrough;

a screen disposed within said chamber proximate said orifice;

a magnetostrictive ring disposed within said chamber which radially expands and contracts to alternately increase and decrease said chamber volume;

windings associated with said magnetostrictive ring and connected to said external actuating source through said access hole;

a sheathing encapsulating said magnetostrictive ring and forming a substantially impermeable membrane between the fluid and said magnetostrictive ring, said sheathing being sufficiently elastic so as to allow unimpeded expansion and contraction of said magnetostrictive ring;

a dampening element at least partially interposed between said magnetostrictive ring and said housing; and a pressure transducer positioned within said inner wall and at least partially exposed to said chamber.

12. The apparatus of claim 11 wherein said magnetostrictive ring, chamber volume and orifice copperate to induce a Helmholtz resonance frequency in the fluid in said chamber.

13. A method for determining formation pressure at a point in a borehole wall, during drilling using drilling fluids, comprising:

(a) positioning a pressure transducer along the drill string in the vicinity of the drill bit;

(b) flushing the borehole wall clean of mudcake by providing a chamber in fluid communication with the drilling fluids via an orifice and inducing a modulation of fluids within said chamber;

(c) receiving a formation pressure reading at the pressure transducer; and (d) transmitting the pressure reading to the surface.

14. A method for determining formation pressure at a point in a borehole wall, during drilling using drilling fluids, comprising:

positioning a pressure transducer along the drill string in the vicinity of the drill bit;

(b) flushing the borehole wall clean of mudcake using an agitated stream of drilling fluid by providing a chamber in fluid communication with the drilling fluids via an orifice and inducing a Helmholtz resonance frequency in the fluid in said chamber;

(c) receiving a formation pressure reading at the pressure transducer; and (d) transmitting the pressure reading to the surface.

15. A method for determining formation pressure at a point in a borehole wall, during drilling using drilling fluids, comprising:

(a) positioning a pressure transducer along the drill string in the vicinity of the drill bit;

(b) flushing the borehole wall clean of mudcake by providing a chamber in fluid communication with the drilling fluids via an orifice and inducing a modulation of fluids within said chamber;

(c) placing the pressure transducer in fluid communication with the formation fluids and in fluid isolation from the drilling fluids; and (c) receiving a formation pressure reading at the pressure transducer.

16. A method for determining formation pressure at a point in a borehole wall, during drilling using drilling fluids, comprising:

(a) positioning a pressure transducer along the drill string in the vicinity of the drill bit;

(b) flushing the borehole wall clean of mudcake using an agitated stream of drilling fluid by providing a chamber in fluid communication with the drilling fluids via an orifice and inducing a Helmholtz resonance frequency in the fluid in said chamber; and (c) receiving a pressure reading indicative of formation pressure at the pressure transducer.

* * * * *